US011118783B2

(12) United States Patent
Bennett et al.

(10) Patent No.: US 11,118,783 B2
(45) Date of Patent: Sep. 14, 2021

(54) CANDLE MANAGEMENT AND EXTINGUISHING DEVICE

(71) Applicant: CANDLE MATE, INC, Draper, UT (US)

(72) Inventors: Brandy S Bennett, Draper, UT (US); Robert E Simons, Draper, UT (US); Arthur L Bentley, Draper, UT (US); James Ryan Francis, American Fork, UT (US)

( * ) Notice: Subject to any disclaimer, the term of this patent is extended or adjusted under 35 U.S.C. 154(b) by 0 days.

(21) Appl. No.: 15/930,213

(22) Filed: May 12, 2020

(65) Prior Publication Data

US 2020/0363062 A1 Nov. 19, 2020

Related U.S. Application Data

(60) Provisional application No. 62/847,814, filed on May 14, 2019.

(51) Int. Cl.

| | |
|---|---|
| ***F23Q 25/00*** | (2006.01) |
| ***F21V 31/00*** | (2006.01) |
| ***F21V 35/00*** | (2006.01) |

(52) U.S. Cl.

CPC ..... *F23Q 25/00* (2013.01); *F21V 31/005* (2013.01); *F21V 35/00* (2013.01)

(58) Field of Classification Search

CPC ..... F23Q 25/00; F21V 31/005; F21V 35/00

See application file for complete search history.

(56) References Cited

U.S. PATENT DOCUMENTS

| | | | | |
|---|---|---|---|---|
| 4,941,588 | A | 7/1990 | Flider | |
| 5,248,259 | A | 9/1993 | Naito et al. | |
| 6,494,708 | B1 | 12/2002 | Hart et al. | |
| 6,572,365 | B1 | 6/2003 | Byxbe | |
| 7,708,137 | B1 | 5/2010 | Rowley, Jr. et al. | |
| 8,469,701 | B2 | 6/2013 | Quinn et al. | |
| 8,920,157 | B2 | 12/2014 | Billy | |
| 9,188,327 | B2 | 11/2015 | Billy | |
| 10,544,938 | B2 | 1/2020 | Gaudioso | |
| 2003/0134242 | A1* | 7/2003 | Hart | F23Q 25/00 431/33 |
| 2007/0031769 | A1* | 2/2007 | Burton | F23Q 25/00 431/144 |
| 2007/0072140 | A1 | 3/2007 | Almodovar | |
| 2007/0236923 | A1 | 10/2007 | Fan | |
| 2009/0029304 | A1 | 1/2009 | Steinmann et al. | |
| 2009/0068607 | A1 | 3/2009 | Konkle | |
| 2014/0197169 | A1 | 7/2014 | Carlile et al. | |
| 2015/0001219 | A1 | 1/2015 | Hess et al. | |
| 2015/0282587 | A1 | 10/2015 | Earl et al. | |
| 2018/0031236 | A1 | 2/2018 | Gaudioso | |

* cited by examiner

*Primary Examiner* — Thomas M Sember

(74) *Attorney, Agent, or Firm* — Pate Peterson PLLC; Brett Peterson

(57) ABSTRACT

A candle management device automatically extinguishes a burning candle upon expiration of a user selected time period. The device shields the candle from foreign objects and reduces the risk of undesired combustion. The doors and actuation mechanism used to isolate the candle from the atmosphere and extinguish the candle are contained within the candle management device and are kept from operational interference by outside objects.

19 Claims, 14 Drawing Sheets

CANDLE MANAGEMENT AND EXTINGUISHING DEVICE

PRIORITY

The present application claims the benefit of U.S. Provisional Application Ser. No. 62/847,814, filed May 14, 2019, which is herein incorporated by reference in its entirety.

THE FIELD OF THE INVENTION

The present invention relates to candles. In particular, examples of the present invention relate to a device for managing a burning candle and automatically extinguishing the candle after a desired period of time.

BACKGROUND

Many persons enjoy burning candles. A burning candle provides a visually appealing display and can also release fragrance. For many people, a burning candle is calming and therapeutic. Burning candles do increase the risk of accidental fire and need to be handled carefully.

BRIEF DESCRIPTION OF THE DRAWINGS

Non-limiting and non-exhaustive examples of the present invention are described with reference to the following figures, wherein like reference numerals refer to like parts throughout the various views unless otherwise specified.

Figure 1:
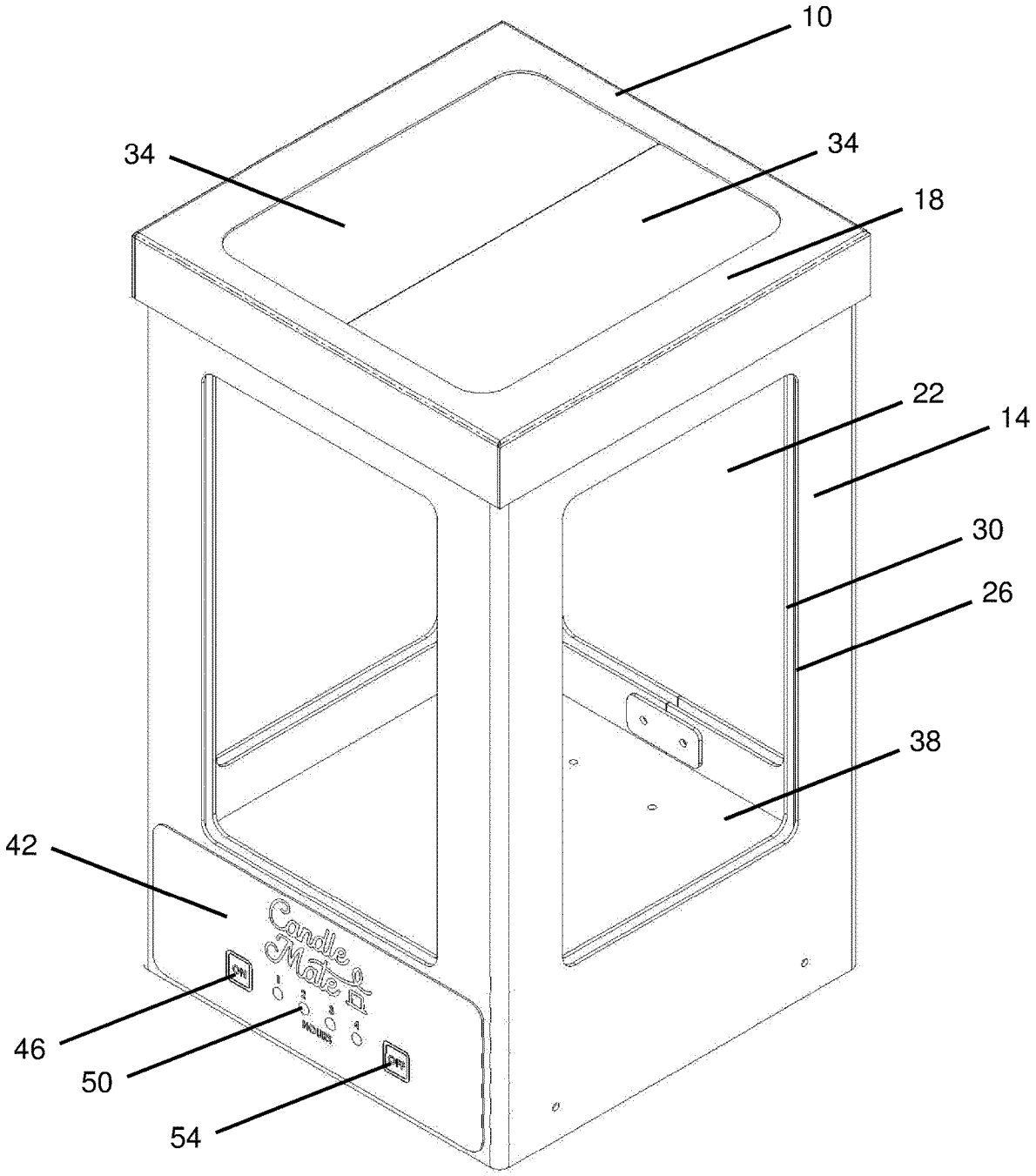
FIG. 1 is a drawing which shows an isometric view of a candle management device.

Corresponding reference characters indicate corresponding components throughout the several views of the drawings. Unless otherwise noted, the drawings have been drawn to scale. Skilled artisans will appreciate that elements in the figures are illustrated for simplicity and clarity. For example, the dimensions of some of the elements in the figures may be exaggerated relative to other elements to help improve understanding of various examples of the present invention. Also, common but well-understood elements that are useful or necessary in a commercially feasible embodiment are often not depicted in order to facilitate a less obstructed view of these various embodiments of the present invention.

It will be appreciated that the drawings are illustrative and not limiting of the scope of the invention which is defined by the appended claims. The examples shown each accomplish various different advantages. It is appreciated that it is not possible to clearly show each element or advantage in a single figure, and as such, multiple figures are presented to separately illustrate the various details of the examples in greater clarity. Similarly, not every example need accomplish all advantages of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

In the above disclosure, reference has been made to the accompanying drawings, which form a part hereof, and in which are shown by way of illustration specific implementations in which the disclosure may be practiced. It is understood that other implementations may be utilized and structural changes may be made without departing from the scope of the present disclosure. References in the specification to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, such feature, structure, or characteristic may be used in connection with other embodiments whether or not explicitly described. The particular features, structures or characteristics may be combined in any suitable combination and/or sub-combinations in one or more embodiments or examples. It is appreciated that the figures provided herewith are for explanation purposes to persons ordinarily skilled in the art.

As used herein, "adjacent" refers to near or close sufficient to achieve a desired effect. Although direct contact is common, adjacent can broadly allow for spaced apart features.

As used herein, the singular forms "a," and, "the" include plural referents unless the context clearly dictates otherwise.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be such as to have the same overall result as if absolute and total completion were obtained. The use of "substantially" is equally applicable when used in a negative connotation to refer to the complete or near complete lack of an action, characteristic, property, state, structure, item, or result. For example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a number or numerical range endpoint by providing that a given value may be "a little above" or "a little below" the number or endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

The candle management device provides an enclosure which receives a candle. The candle may be lit and burned while inside of the candle management device. The device includes upper doors which are opened to allow the candle to be lit and to allow a continuous oxygen supply so that the candle can continue burning. The candle management device includes an internal control board and control motor which are connected to the doors. The control board and control motor close the doors when desired. The doors, when closed, limit the supply of oxygen to the candle and extinguish the candle. The control board allows a user to select a desired amount of time for the candle to burn and can automatically close the doors after the expiration of the time period.

Turning now to FIG. 1, an isometric view of a candle management device 10 is shown. The candle management device 10 is rectangular in shape and is typically between about 5 inches wide and deep and about 8 inches tall and about 7 inches wide and about 12 inches tall. These sizes will accommodate many popular candles. The candle management device 10 includes a body with closed side walls 14 (e.g. front, back, left, and right walls) and a top 18. Each of the four side walls 14 includes a transparent or decorative window pane 22 which allows a user to observe and enjoy a candle which is placed inside of the candle management device 10. In the example embodiment, the walls 14 are formed by an exterior wall or exterior housing 26 and an interior wall or interior housing 30 with a space formed between the exterior housing 26 and the interior housing 30. Window openings are formed in the exterior housing 26 and the interior housing 30 and the window panes 22 are held between the exterior housing 26 and the interior housing 30 and extend across the window openings. The exterior housing 26 may be formed from a thin sheet of metal which is cut and bent into the rectangular shape shown. Similarly, the interior housing 30 may also be formed from a thin sheet of metal which is cut and bent into the rectangular shape shown. The exterior housing 26 and the interior housing 30 both extend around the front, left, right, and back faces of the candle management device 10 and have edges which are joined together on the back of the device 10.

The top 18 extends across the top end of the body of the candle management device 10 and is attached to the top of the exterior housing 26 and the interior housing 30. The top 18 has side flanges which extend downwardly around the top portion of the exterior housing 26. An opening 36 is formed in the top 18 to allow ingress and egress of a candle. The top 18 includes two doors 34 which, when closed, close the opening 36 and which open inwardly to allow access to the candle and which close to isolate the candle from the environment. The doors 34 are attached to the exterior housing 26 or to the interior housing 30 near the side wall corners via pivot points or hinges. The inside edges of the doors swing downwardly and outwardly to open the doors 34 as the doors 34 pivot about their attachment points. Accordingly, the doors 34 swing through the interior space of the candle management device 10 during operation. When closed, the doors 34 are positioned adjacent the bottom surface of the top 18 and the inside edges of the doors 34 are positioned adjacent each other so that the doors 34 block the opening 36. The candle management device 10 includes a floor 38 which is located above the bottom of the device 10. The floor 38 provides a support surface which receives a candle and supports the candle during use of the device 10. The candle management device 10 includes a space between the floor 38 and the bottom of the device 10 which houses a control circuit and control motor for operation of the doors 34.

A control panel 42 is located on the front of the candle management device 10. The control panel 42 allows a user to operate the candle management device 10 in connection with burning a candle. The control panel 42 is connected to a power source and a circuit board with a computer processor (not shown). The control panel 42 is typically connected to the mains power of a building via a power cable and the candle management device 10 is powered from the mains power of a building. Alternatively, the power source may be a small power supply or an onboard or external battery. The candle management device 10 typically includes a power cord extending from the back side of the device or, alternatively, a power jack on the back of the device for connection to a power supply, charger, or battery.

The circuit board includes a computer processor (such as a programmable logic chip), power connections, input connections and output connections which are connected to the control panel 42, and output connections to a control motor which operates the doors 34. In the present example, the control motor is a small servo motor with onboard positioning feedback. The control motor receives a pwm signal from the microprocessor and moves to an output position according to the pulse width of the signal from the microprocessor. In the example device, the microprocessor may generate a first signal indicative of a closed door position or a second signal indicative of an open door position and the servo motor may move between a corresponding open position and closed position. The servo motor is connected to the doors 34 via a pushrod and lever system so that the doors 34 are moved into corresponding open and closed positions.

The microprocessor receives a selection of an input state from a user via the control panel 42. As shown, the control panel 42 may include an on button/switch 46, indicator lights 50 (e.g. led indicators) which indicate a selected time increment, and an off button/switch 54. The microcontroller receives signals from the on button 46 and the off button 54 and sends signals to illuminate the indicator lights 50 according to a selected time increment. A user may press the on button 46 to turn the candle management device 10 on and may press the on button 54 repeatedly to cycle through predetermined time intervals for burning a candle. As shown, the processor is programmed for 1, 2, 3, and 4 hour operating times and a user may press the on button 46 to cycle between 1, 2, 3, and 4 hours operation time for burning a candle. Pressing the off button 54 will clear the selected time increment and shut down the candle management device.

The processor is connected to the servo motor such that the servo motor is operated to move to an on position and open the doors 34 when the device is turned on and keeps the doors 34 in an open position during the user selected time for burning a candle. Typically, the servo motor is connected to the processor circuit board via a ground wire, a power wire, and a signal wire and receives power from the control circuit board. The processor includes an internal clock which records time. The processor may count down from the user selected amount of operation time or may count up and compare the elapsed time with the user selected operation time. When the user selected time has passed, the processor moves the servo motor to a closed position to thereby close the doors 34. Alternatively, the user may press the off button 54 during the selected operation time to close the doors 34 and stop burning the candle. Closing the doors 34 limits the supply of oxygen to the candle and causes the candle to extinguish when the oxygen inside of the candle management device 34 has been consumed by the burning candle.

The candle management device 10 may also include an internal rechargeable battery or capacitor connected to the processor and control motor. The internal battery/capacitor may close the doors 34 in the case of a power outage. In the case of a power outage, the processor (drawing power from the internal battery/capacitor may sense the loss of power from the power supply used for normal operation and stop the candle from burning by outputting a signal to move the servo motor to a closed position to close the doors. Accordingly, the candle is prevented from burning unattended during a power outage.

Figure 2:
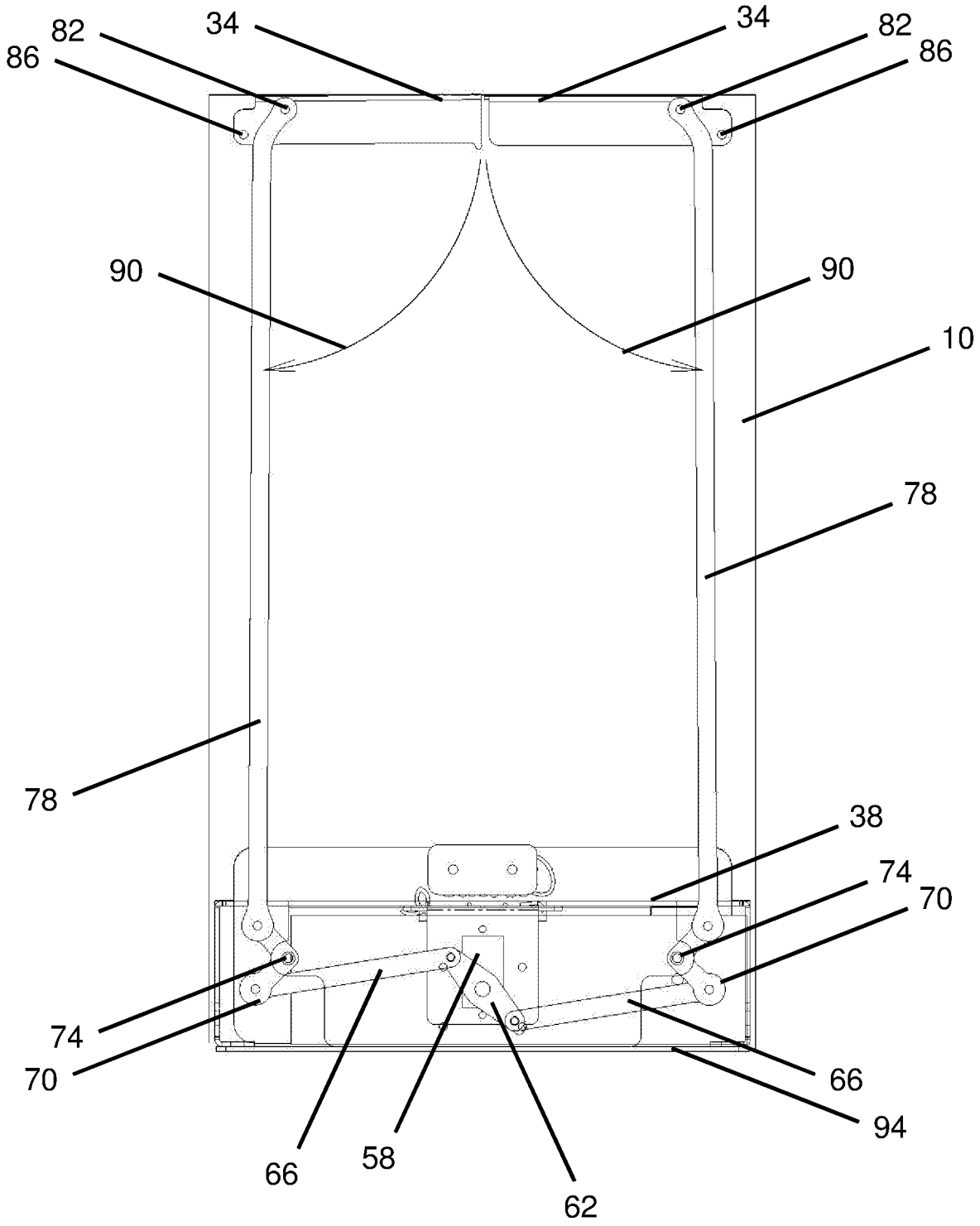
FIG. 2 is a drawing which shows a back view of a portion of the candle management device.

FIG. 2 shows a back view of the candle management device 10 with the lid 18, exterior housing 26, interior housing 30, and window panes 22 removed. This view shows the servo motor and control linkages used to operate the doors 34. As discussed above, the candle management device includes a control motor 58 which is typically a small, self-contained, servo motor. The servo motor 58 includes an output shaft which is connected to an output lever 62. The output shaft is connected internally to a potentiometer or rotary encoder which allows the servo motor to regulate its output position via an internal control board. The servo motor 58 receives power and a control signal from the circuit board of the candle management device 10. The servo motor output lever 62 includes two arms extending in opposite directions from the servo motor output shaft. The two arms are each pivotably connected to inner ends of lower control rods 66 which extend laterally towards the sides of the candle management device 10. The outer ends of the lower control rods 66 are pivotably connected to first arms of bellcranks 70. The bellcranks 70 are pivotably connected to the frame of the candle management device 10 at pivots 74. Second arms of the bellcranks 70 are pivotably connected to lower ends of upper control rods 78. The upper ends of the upper control rods 78 are pivotably connected to the doors 34 at a pivot 82. The doors 34 are pivotably connected to the frame of the candle management device 10 (e.g. to the interior housing 30, exterior housing 26, or lid 18) at pivots 86.

The servo motor 58 and door control linkages are shown in a closed position in FIG. 2. The example servo motor 58 rotates its output shaft approximately 90 degrees from the open position to the closed position or vice-versa. If the control circuit board sends an open signal to the servo motor 58, the output shaft will rotate approximately 90 degrees in a clockwise direction. This will cause the output lever 62 to pull on the lower control rods 66; rotating the right bellcrank 70 in a clockwise direction and the left bellcrank 70 in a counter-clockwise direction approximately 90 degrees. The rotation of the bellcranks 70 will pull the upper control rods 78 downwardly and cause the doors 34 to rotate downwardly as indicated by arrows 90. The doors 34 pivot downwardly by approximately 90 degrees to reach an open position. In the open position, the doors 34 extend downwardly adjacent to the left and right walls 14 of the candle management device 10. When the control circuit board sends a closed signal to the servo motor 58, the motor will rotate in a counter-clockwise direction by approximately 90 degrees and return to the position shown.

The control circuit board, control motor 58, output lever 62, lower control arms 66, and bellcranks 70 all fit within the space between the floor 38 and the bottom 94 of the candle management device 10. The upper control rods 78 fit in the space between the exterior housing 26 and the interior housing 30 between the corners and the window panes 22. This provides a candle management device 10 which is aesthetically appealing as the control mechanism is hidden from the user. This also provides a candle management device 10 which safer and more reliable as the control mechanism is protected from dust and dirt and is also protected from accidental contact from foreign objects which may bind the control mechanism and prevent proper operation of the device 10.

Figure 3:
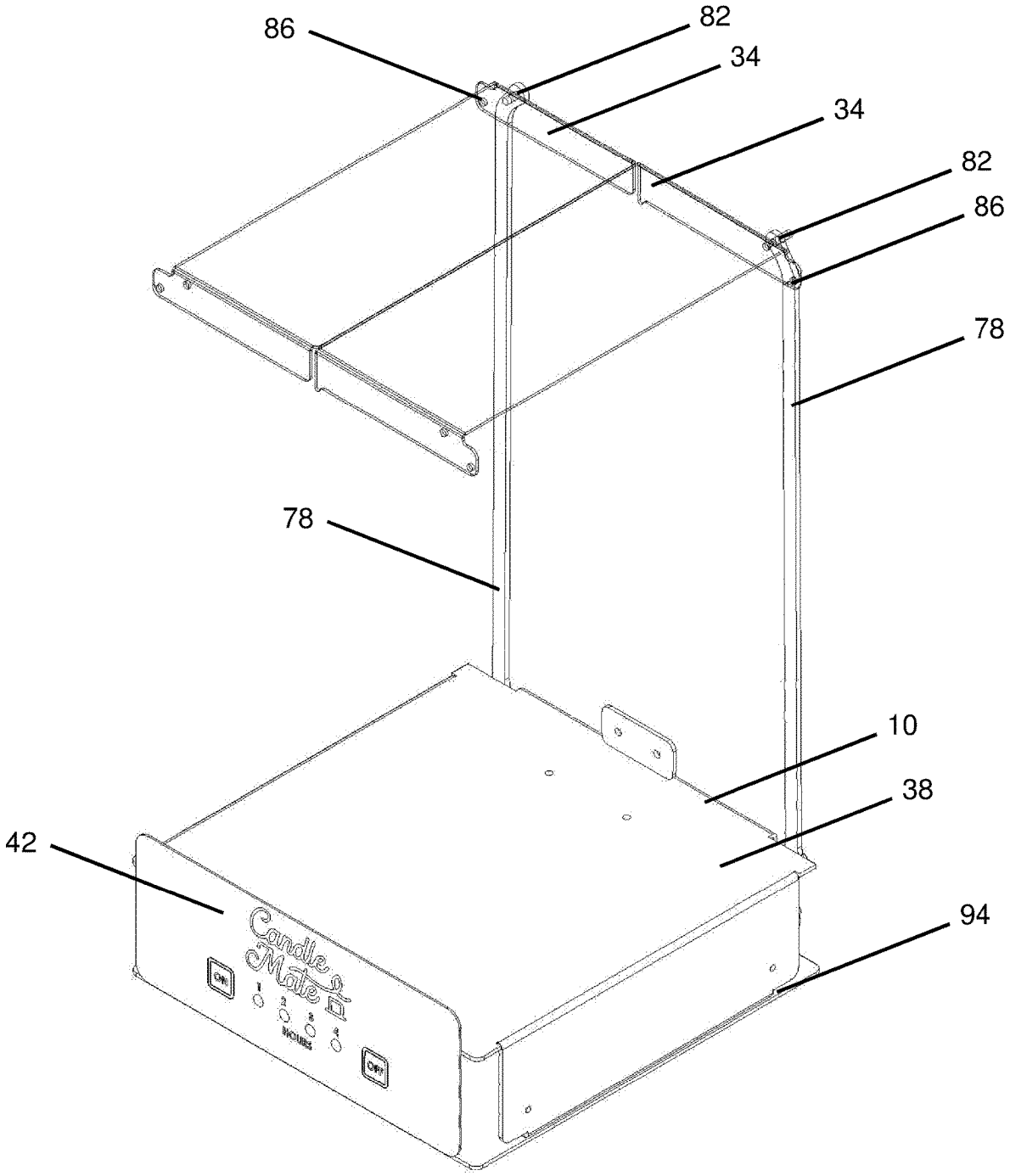
FIG. 3 is a drawing which shows an isometric view of a portion of the candle management device.
Figure 4:
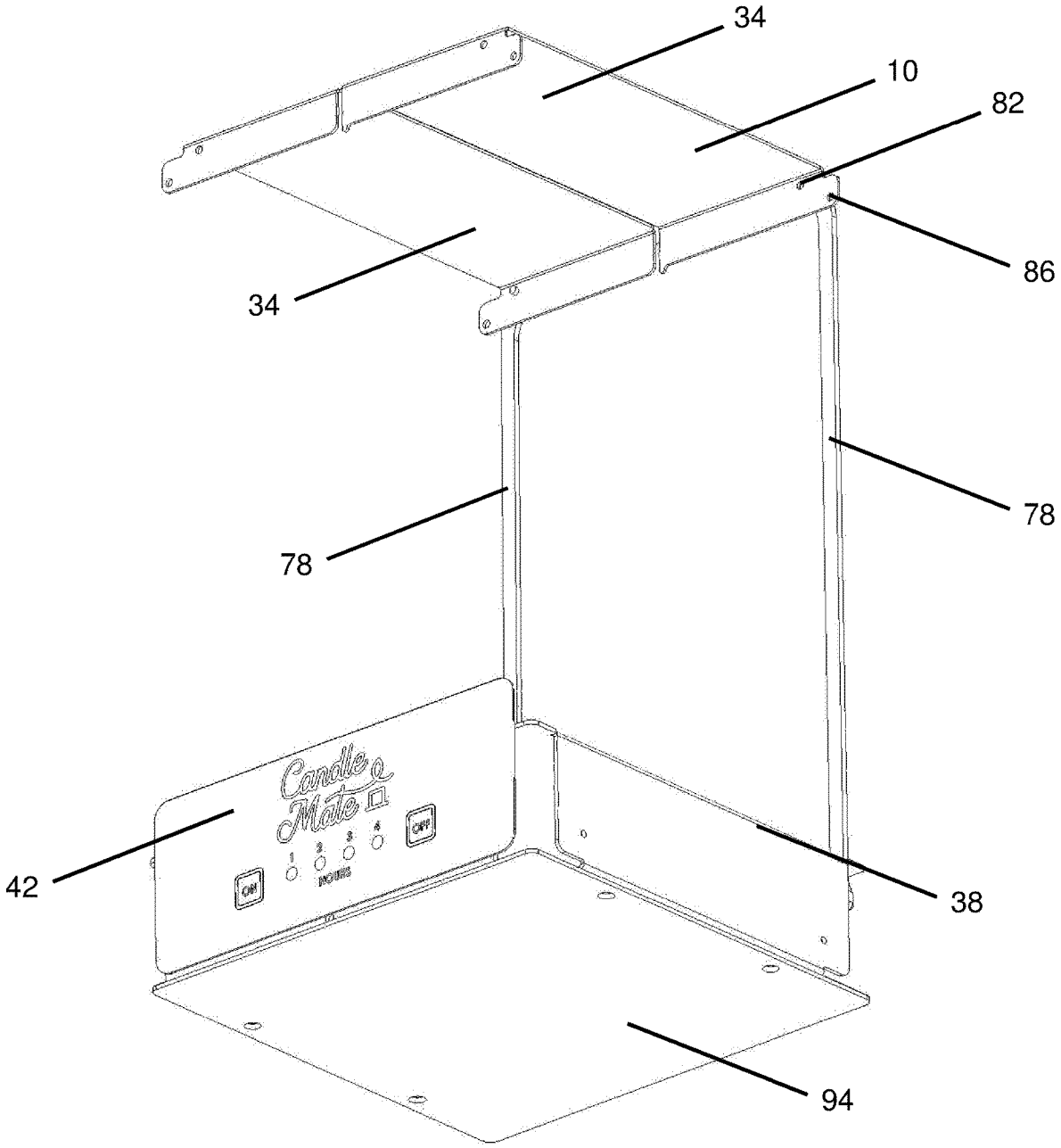
FIG. 4 is a drawing which shows a lower isometric view of a portion of the candle management device.

FIG. 3 shows an isometric view of the candle management device 10. The window panes 22, exterior housing 26, interior housing 30, and top 18 have been removed and the doors 34 have been shown transparent. FIG. 4 similarly shows a lower isometric view of the candle management device 10. The window panes 22, exterior housing 26, interior housing 30, and top 18 have been removed from the drawing. The doors 34 are hinged adjacent the left and right sides of the device 10 near the corners and the upper control rods 78 are connected to the back sides of the doors 34. The upper control rods 78 extend upwardly between the exterior housing 26 and interior housing 30 at the back of the candle management device 10.

Figure 5:
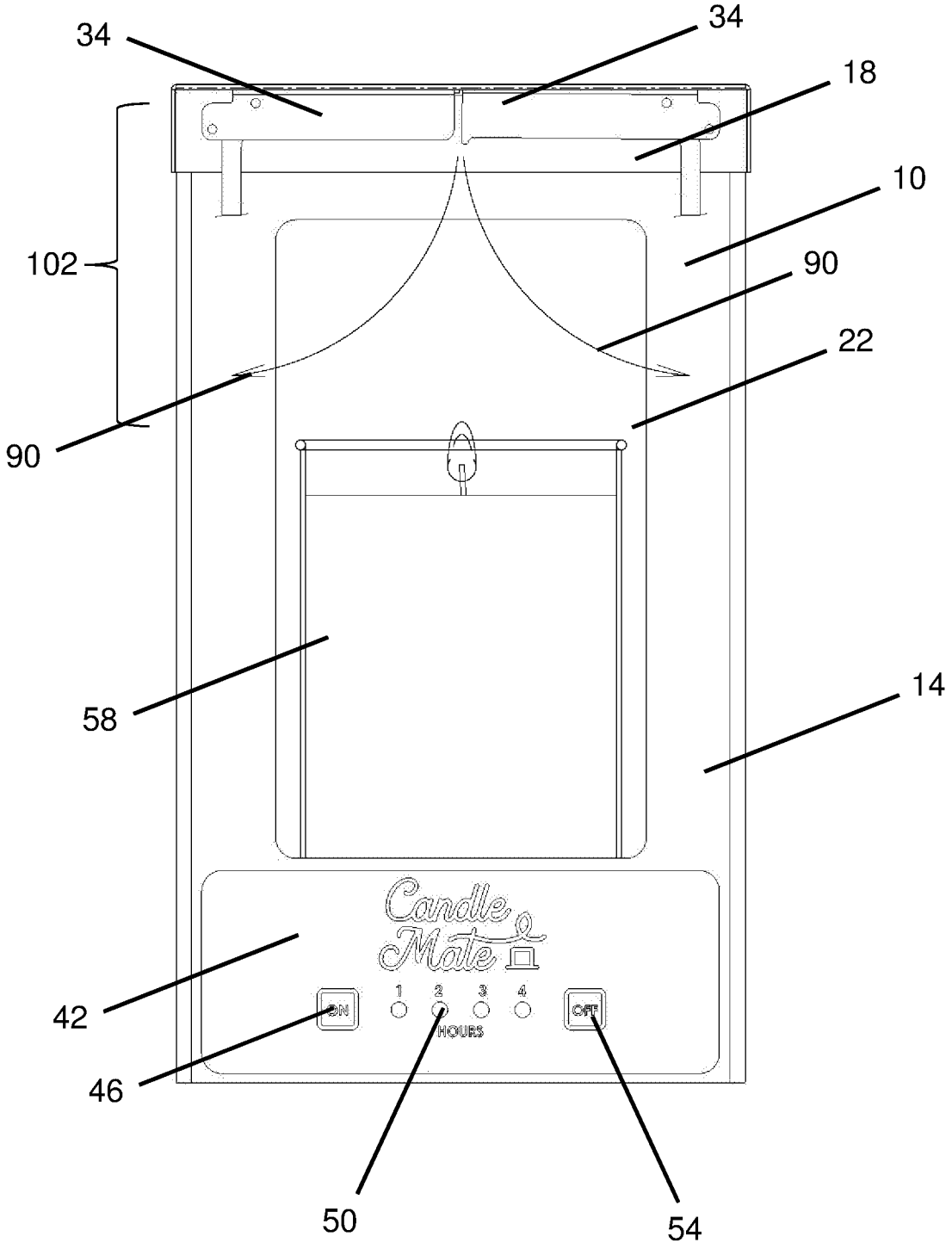
FIG. 5 is a drawing which shows a front view of a candle management device.

FIG. 5 shows a front view of the candle management device 10 with the top 18 shown transparent to illustrate the doors 34. FIG. 5 also shows an example candle 98. During use, a candle 98 is placed into the interior of the candle management device 10. Typically, the user will turn on the candle management device 10 via the on button 46 to thereby open the doors 34. The user then has access to the interior of the candle management device 10 and can place a candle 98 into the device 10 or use a candle 98 which is already in the device 10. The user may press the on button 46 repeatedly to cycle through the time settings and select a desired amount of time for burning the candle 98. The control circuit illuminates one of the indicator lights 50 to indicate the selected time for burning a candle 98. The user may then light and burn the candle 98 with significantly less risk than while burning an unmanaged candle. Foreign objects that accidentally come into contact with the device 10 are kept away from the burning candle 98 because the candle 98 is inside of the management device 10.

Because the doors 34 swing open inwardly as indicated by arrows 90, a headspace 102 is required above the candle 98 to permit operation of the candle management deice 10. This headspace 102 creates a distance between the candle flame and a foreign object which may inadvertently contact the top of the candle management device 10 and lowers the risk of such an object igniting from the candle flame. Accordingly, the candle management device 10 reduces the risk that foreign objects are accidently ignited by the burning candle 98. Additionally, the inwardly opening doors 34 are not at risk of becoming blocked by foreign objects outside of the candle management device 10 and being prevented from moving properly. The walls 14 of the candle management device 10 encompass the space required for movement of the doors 34 and protect the doors 34 from foreign objects, reducing the risk that a foreign object interferes with the operation of the candle management device 10.

When the user selected time expires or when a user presses the off button 54, the control motor 58 closes the doors 34. The doors 34 fit closely against the top 18 and the inside edges of the doors 34 fit closely against each other. This close fitting configuration prevents the exchanges of gasses between the inside of the candle management device 10 and the outside atmosphere. Accordingly, carbon dioxide is accumulated and oxygen is reduced inside of the candle management device 10. The reduction in oxygen will extinguish the candle flame. The doors 34 will also keep the soot typically emitted from a recently extinguished candle inside of the candle management device and out of the outside atmosphere.

Figure 6:
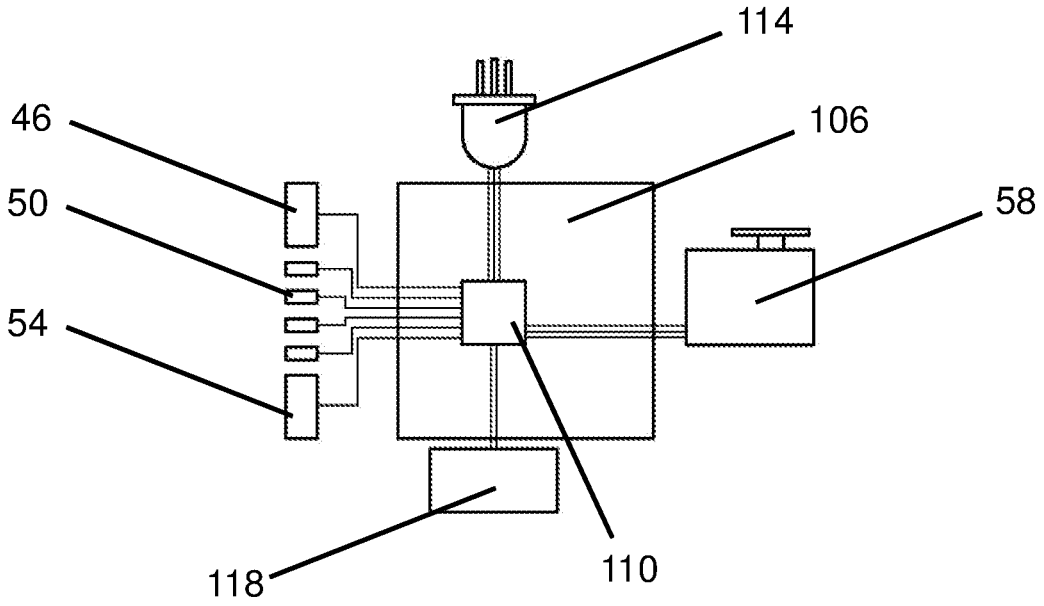
FIG. 6 is a drawing which shows a schematic drawing of the candle management device control electronics.

FIG. 6 shows a schematic diagram of the electronic components for the candle management device 10. The candle management device 10 includes a control board/circuit board 106. The control board 106 includes a processor chip 110. The processor 110 may commonly be a programmable logic chip. If desired, the functions performed by the processor chip 110 may be distributed across multiple processor chips, input and out devices, etc. The processor chip 110 includes various input and output connections which allow the processor chip 110 to communicate with the other electronic devices. For example, the processor chip 110 includes input connections which allow it to receive input signals from the on button 46 and the off button 54 and output connections which allow it to control the indicator lights 50. The processor 110 includes an output connection which allows it to output a control signal such as a pwm signal to control the operation of the servo motor 58. The processor 110 also includes power connections 114 which allow it to receive power from the device power source. The processor may also have power connections which allow it to receive backup power from a backup battery or capacitor 118 to allow the processor to close the doors 34 in the case of loss of its primary power source. In one example, the power source may be building electrical mains and the power connection 114 may be a cord and plug. In another example, the power source may be an external battery and the power connection 114 may be a power socket on the candle management device. In another example, the power connection 114 may be a USB socket which allows the device 10 to be connected to a portable battery supply or other power source via a USB cable. In another example, the candle management device 10 may include a larger internal battery 118 and a power connection 114 such as a USB socket or other power socket may be used to charge the battery or operate the device 10. The control circuit board 106 includes the various circuit traces, connectors, etc. to facilitate the necessary electrical connections. The control circuit board 106 may also include a power transformer or rectifier if necessary. The control circuit board 106 is housed in the space between the floor 38 and the bottom 94. If desired, some or all of the control panel 42, on button 46, indicator lights 50, off button 54, and circuit board 106 may be located in a housing on a power cord 114 or in a housing on a pendant control which is connected to the candle management device 10.

Figure 7:
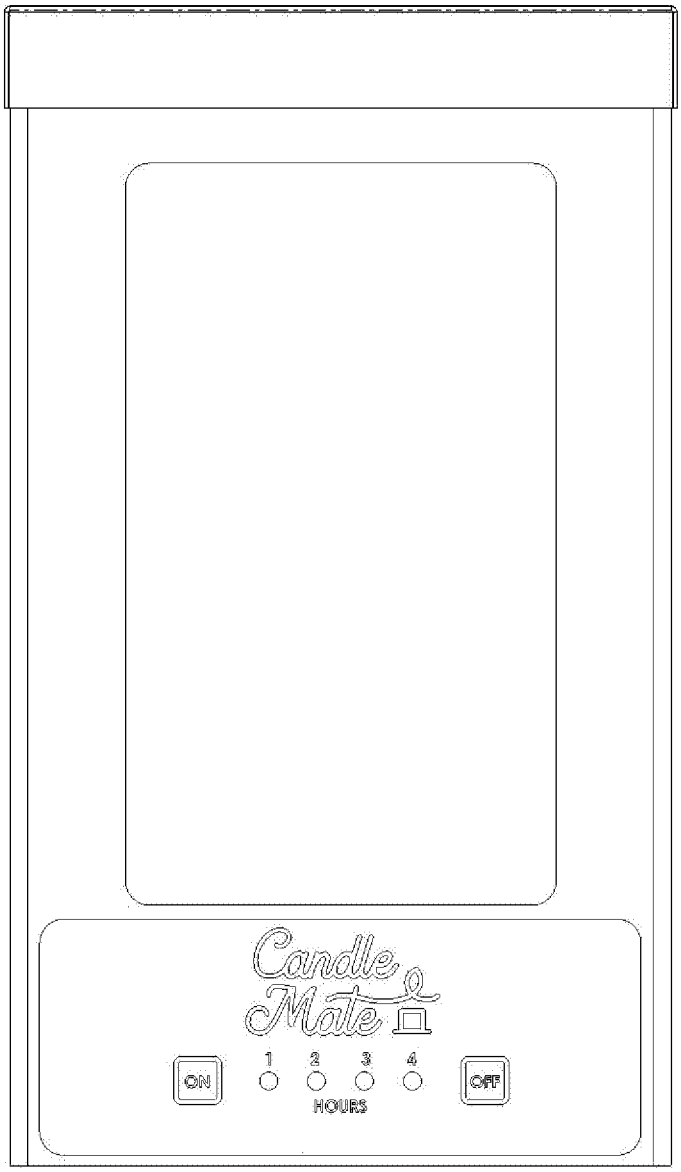
FIG. 7 is a drawing which shows a front view of the candle management device.
Figure 8:
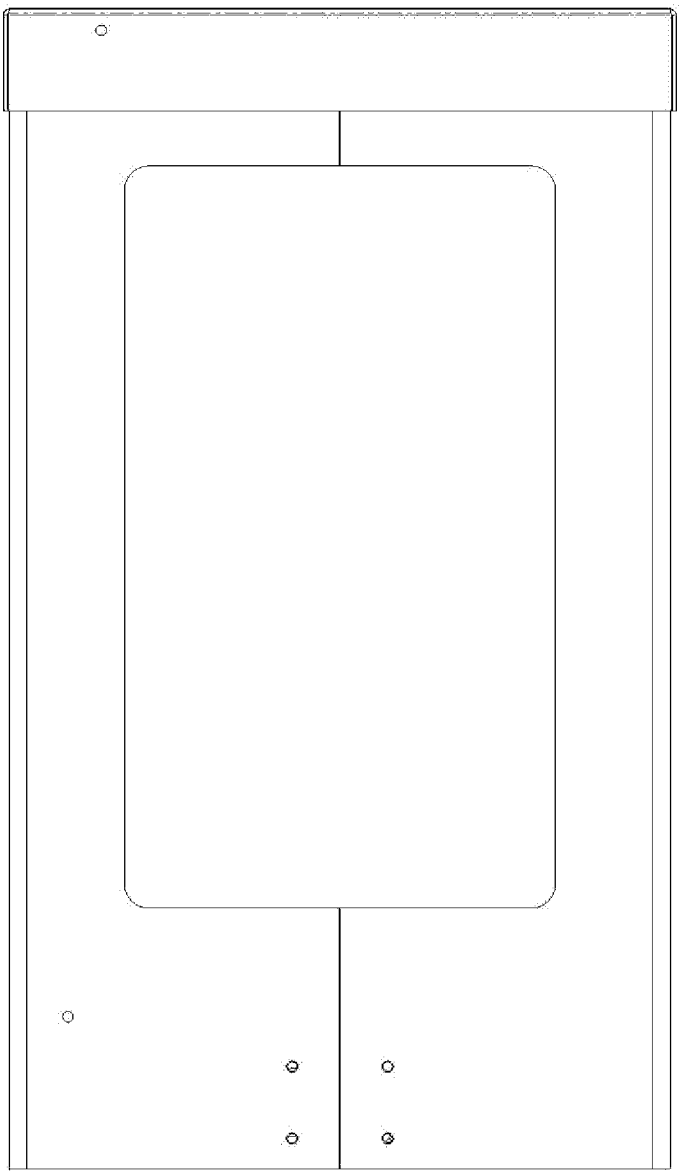
FIG. 8 is a drawing which shows a back view of the candle management device.
Figure 9:
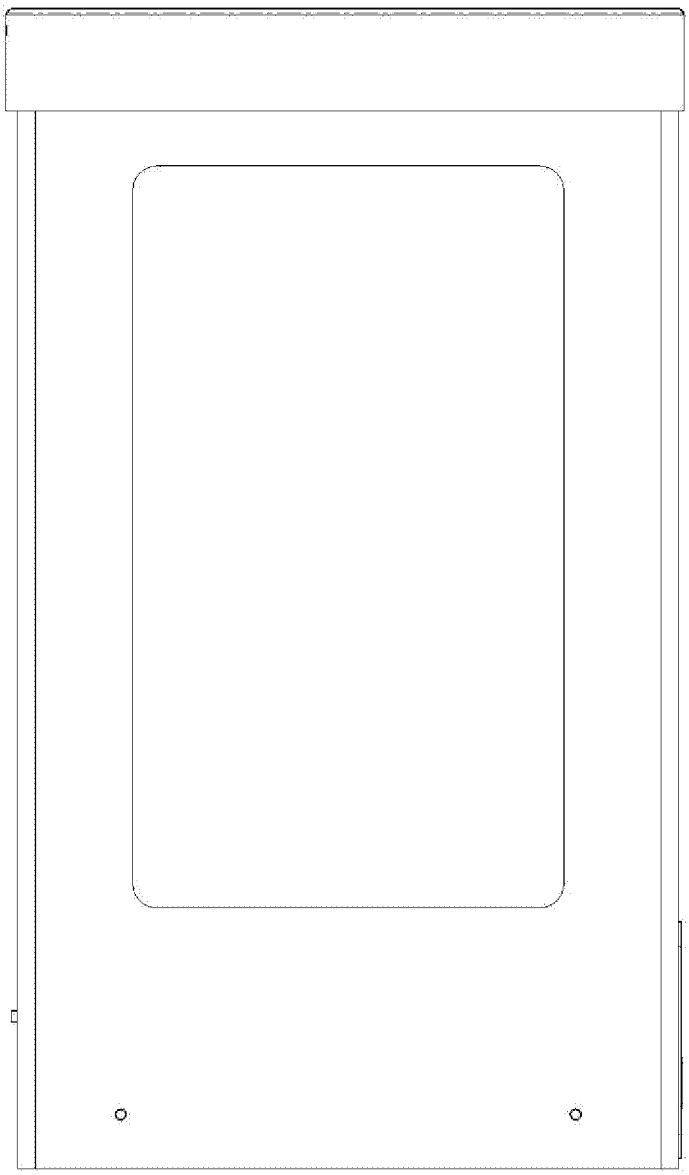
FIG. 9 is a drawing which shows a left view of the candle management device.
Figure 10:
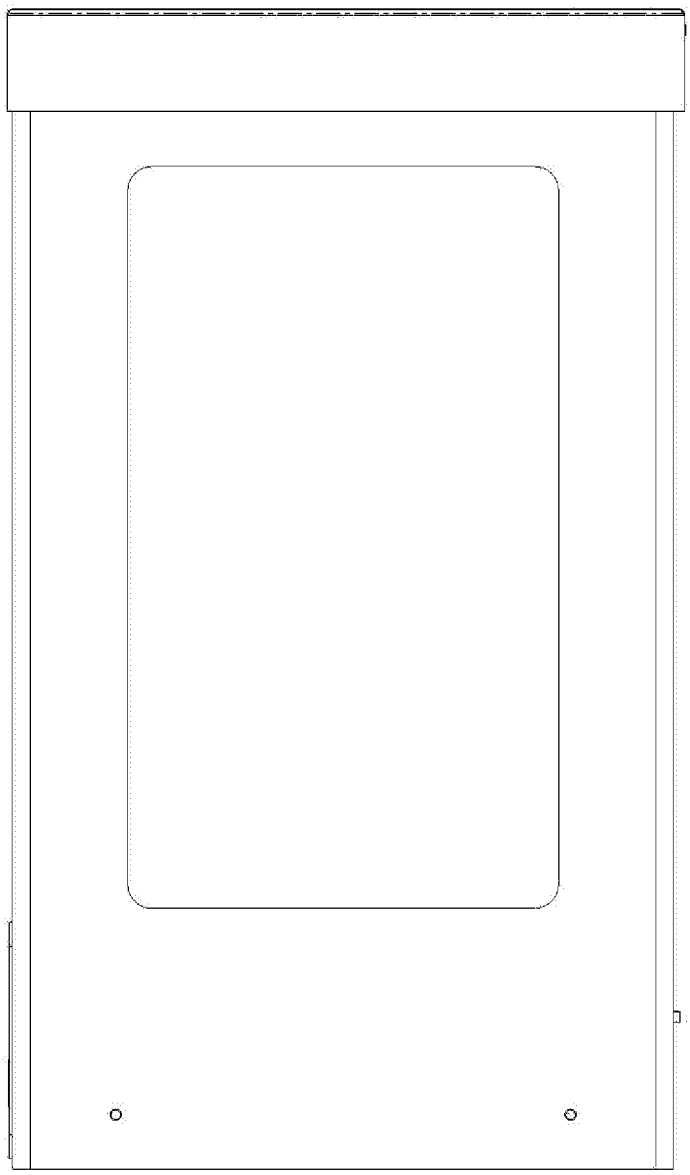
FIG. 10 is a drawing which shows a right view of the candle management device.
Figure 11:
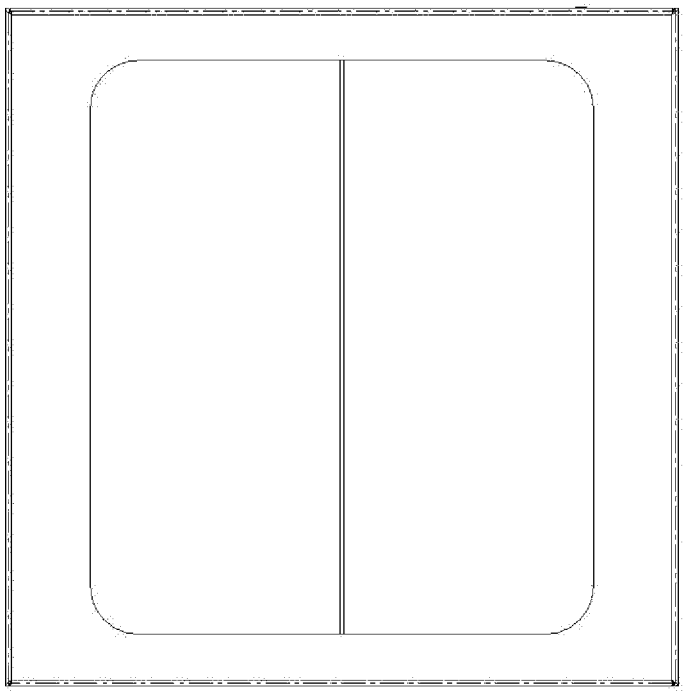
FIG. 11 is a drawing which shows a top view of the candle management device.
Figure 12:
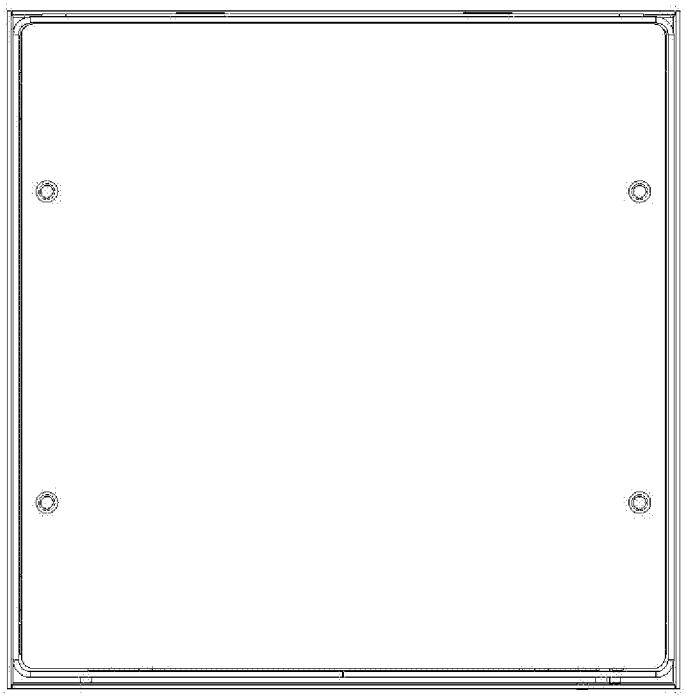
FIG. 12 is a drawing which shows a bottom view of the candle management device.
Figure 13:
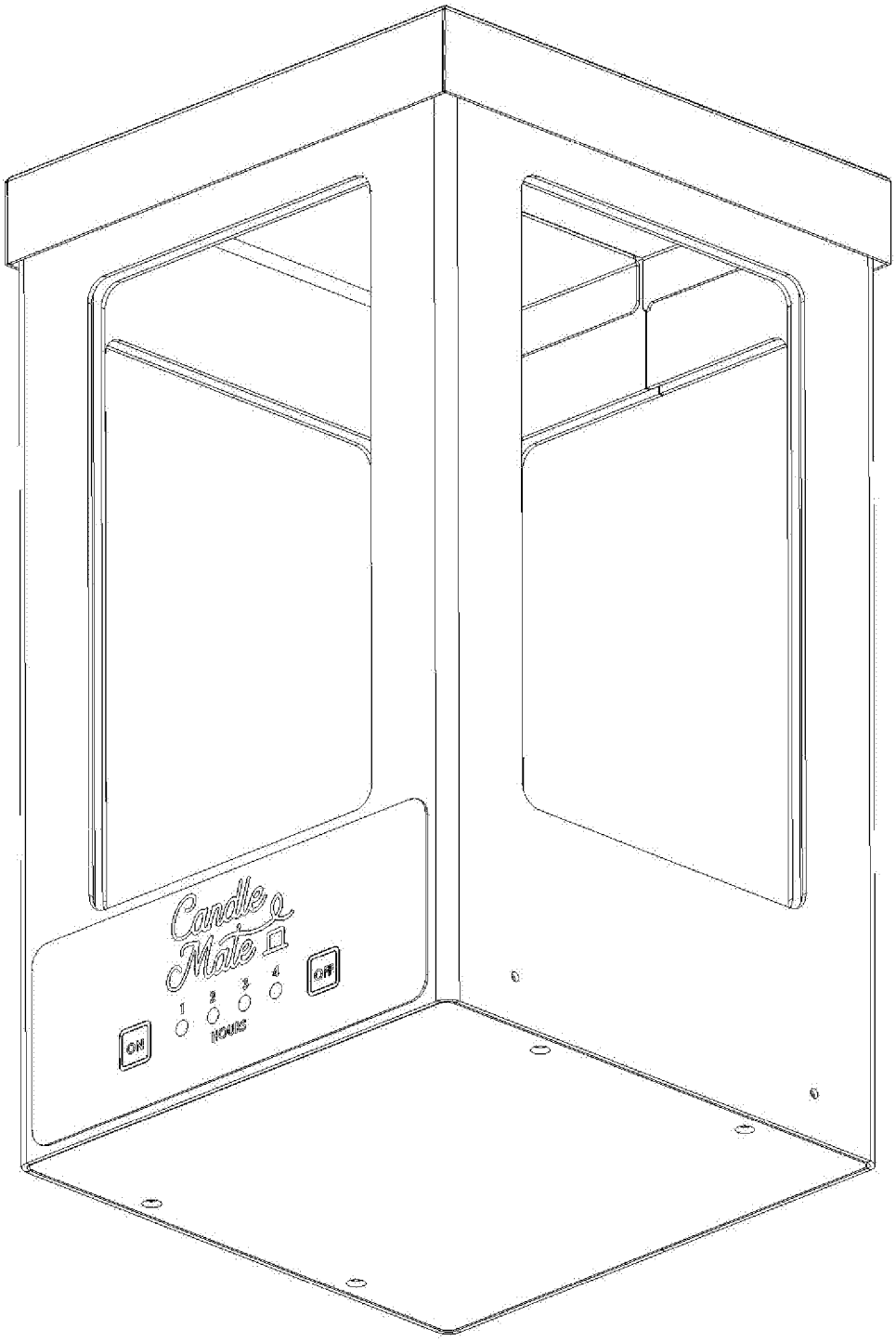
FIG. 13 is a drawing which shows a lower isometric view of the candle management device.
Figure 14:
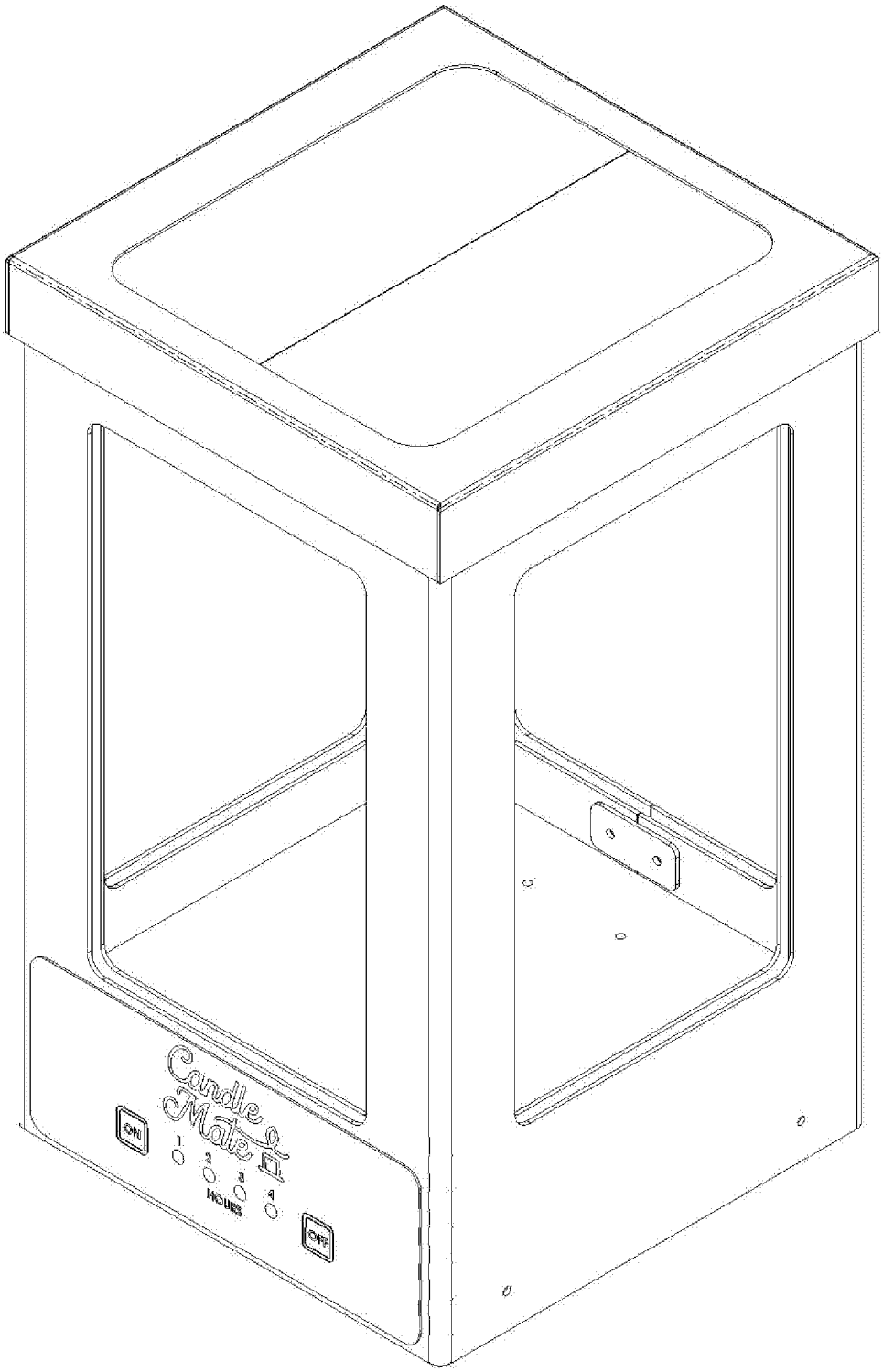
FIG. 14 is a drawing which shows an isometric view of the candle management device.

FIGS. 7 and 8 show a front view and a back view of the candle management device 10. FIGS. 9 and 10 show left and right views of the candle management device 10. FIGS. 11 and 12 show top and bottom views of the candle management device 10. FIG. 13 shows a bottom isometric view of the candle management device 10. FIG. 14 shows an isometric view of the candle management device 10.

The candle management device is beneficial as it provides increased safety while burning a candle while still allowing a user to enjoy the sight and fragrance of the candle. Foreign objects are better shielded from the candle flame and the doors and actuation mechanism is protected from foreign objects.

The above description of illustrated examples of the present invention, including what is described in the Abstract, is not intended to be exhaustive or to be limiting to the precise forms disclosed. While specific examples of the invention are described herein for illustrative purposes, various equivalent modifications are possible without departing from the broader scope of the claims. Indeed, it is appreciated that specific example dimensions, materials, voltages, currents, frequencies, power range values, times, etc., are provided for explanation purposes and that other values may also be employed in other examples in accordance with the teachings of the present invention.

What is claimed is:

1. A candle management device comprising:

a body comprising:

walls extending around a front, left, right, and back of the body;

an interior space configured to receive a candle therein;

a top;

an opening in the top;

a floor adjacent a bottom of the body for supporting the candle;

a first door pivotably attached to a first side of the body adjacent the top of the body;

a second door pivotably attached to a second side of the body adjacent the top of the body;

a control motor configured to move the first door and the second door between an open position and a closed position;

wherein, in the closed position, the first door and the second door are disposed horizontally at a position adjacent the top of the body and wherein the first door and the second door close the top opening to isolate the interior space from the atmosphere;

wherein, in the open position, the first door and the second door are located within the interior space and wherein the first door is disposed adjacent the first side of the body and the second door is disposed adjacent the second side of the body; and wherein the control motor moves the first door and the second door between the open position and the closed position by pivoting the first door and the second door through the interior space.

2. The candle management device of claim 1, wherein the control motor is located adjacent a bottom of the body, wherein the control motor is connected to the first door by a first upper control rod which extends vertically through the body, and wherein the control motor is connected to the second door by a second upper control rod which extend vertically through the body.

3. The candle management device of claim 2, wherein the body comprises side walls having an exterior housing and an interior housing separated from the exterior housing, wherein the interior space is located inside of the interior housing, and wherein the first upper control rod and the second upper control rod extend vertically between the interior housing and the exterior housing.

4. The candle management device of claim 3, further comprising a window opening in the interior housing and the exterior housing and a window pane held between the interior housing and the exterior housing.

5. The candle management device of claim 2, further comprising:

an output lever attached to an output shaft of a control motor;

a first lower control rod connected to the output lever and extending within a lower enclosed space within the body which is separated from the interior space;

a first bellcrank attached to the first lower control rod;

a second lower control rod connected to the output lever and extending within the lower enclosed space;

a second bellcrank attached to the second lower control rod;

wherein the first upper control rod is connected to the first bellcrank; and wherein the second upper control rod is connected to the second bellcrank.

6. The candle management device of claim 1, further comprising a control circuit configured to:

open the first door and the second door in response to a user input;

receive a user input to select a time period for burning a candle; and automatically close the first door and the second door after the expiration of the time period to extinguish the candle.

7. A candle management device comprising:

a body comprising:

a peripheral wall having a front, left, right, and back;

an interior space configured to receive a candle therein;

a top;

an opening in the top;

a floor adjacent a bottom of the body for supporting the candle;

a first door pivotably attached to the body adjacent the top of the body;

a control motor configured to move the first door between an open position and a closed position;

a control circuit electrically connected to the control motor and configured to automatically operate the control motor to thereby close the first door;

wherein, in the closed position, the first door is disposed horizontally at a position adjacent the top of the body and wherein the first door closes the top opening to isolate the interior space from the atmosphere;

wherein, in the open position, the first door is located within the interior space; and wherein the control motor moves the first door between the open position and the closed position by pivoting the first door through the interior space.

8. The candle management device of claim 7, wherein the control motor is located adjacent a bottom of the body beneath the floor, and wherein the control motor is connected to the first door by a first upper control rod which extends vertically through the body.

9. The candle management device of claim 8, wherein the peripheral wall comprises an exterior wall and an interior wall separated from the exterior wall to create a space therebetween, wherein the interior space is located inside of the interior wall, and wherein the first upper control rod extends vertically between in the space between the interior housing and the exterior housing.

10. The candle management device of claim 9, further comprising a window opening in the interior housing and the exterior housing and a window pane held between the interior housing and the exterior housing.

11. The candle management device of claim 8, further comprising:

an output lever attached to an output shaft of a control motor;

a first lower control rod connected to the output lever and extending within a lower enclosed space which is beneath the floor and separated from the interior space;

a first bellcrank attached to the first lower control rod; and wherein the first upper control rod is connected to the first bellcrank.

12. The candle management device of claim 7, wherein the control circuit is configured to:

open the first door in response to a user input;

receive a user input to select a time period for burning a candle; and automatically close the first door after the expiration of the time period to extinguish the candle.

13. The candle management device of claim 7, further comprising:

a second door pivotably attached to the body adjacent the top of the body; and wherein the control motor is configured to move the first door and the second door between an open position and a closed position.

14. A candle management device comprising:

a body comprising:

a peripheral wall having a front, left, right, and back;

an interior space configured to receive a candle therein;

a top;

an opening in the top;

a floor adjacent a bottom of the body for supporting the candle;

a first door pivotably attached to the body adjacent the top of the body;

a control motor configured to move the first door between an open position and a closed position;

a control circuit electrically connected to the control motor and configured to automatically operate the control motor to thereby close the first door;

wherein, in the closed position, the first door is disposed horizontally at a position adjacent the top of the body and wherein the first door closes the top opening to isolate the interior space from the atmosphere;

wherein the control motor is located adjacent a bottom of the body beneath the floor, and wherein the control motor is connected to the first door by a first upper control rod which extends vertically through the body; and wherein the peripheral wall comprises an exterior wall and an interior wall separated from the exterior wall to create a space therebetween, wherein the interior space is located inside of the interior wall, and wherein the first upper control rod extends vertically between in the space between the interior housing and the exterior housing.

15. The candle management device of claim 14, wherein, in the open position, the first door is located within the interior space; and wherein the control motor moves the first door between the open position and the closed position by pivoting the first door through the interior space.

16. The candle management device of claim 14, further comprising:

an output lever attached to an output shaft of a control motor;

a first lower control rod connected to the output lever and extending within a lower enclosed space which is beneath the floor and separated from the interior space;

a first bellcrank attached to the first lower control rod; and wherein the first upper control rod is connected to the first bellcrank.

17. The candle management device of claim 14, wherein the control circuit is configured to:

open the first door in response to a user input;

receive a user input to select a time period for burning a candle; and automatically close the first door after the expiration of the time period to extinguish the candle.

18. The candle management device of claim 14, further comprising a window opening in the interior housing and the exterior housing and a window pane held between the interior housing and the exterior housing.

19. The candle management device of claim 14, further comprising:

a second door pivotably attached to the body adjacent the top of the body; and wherein the control motor is configured to move the first door and the second door between an open position and a closed position.

* * * * *